US007705801B2

(12) United States Patent
Fu et al.

(10) Patent No.: US 7,705,801 B2
(45) Date of Patent: Apr. 27, 2010

(54) DRIVING METHOD

(75) Inventors: Chung-Lin Fu, Hsinchu County (TW); Yu-Ting Chien, Taipei County (TW); Chi-Hsiu Lin, Yunlin County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 655 days.

(21) Appl. No.: 10/904,296

(22) Filed: Nov. 3, 2004

(65) Prior Publication Data

US 2006/0097960 A1 May 11, 2006

(30) Foreign Application Priority Data

Oct. 22, 2004 (TW) ..... 93132119 A

(51) Int. Cl.
*G09G 3/28* (2006.01)

(52) U.S. Cl. ..... 345/60; 345/66

(58) Field of Classification Search ..... 345/60, 345/66, 204, 67; 315/169.4, 169.3
See application file for complete search history.

(56) References Cited

U.S. PATENT DOCUMENTS 6,512,501 B1 * 1/2003 Nagaoka et al. ..... 345/66
2001/0005190 A1 * 6/2001 Furutani ..... 345/60
2001/0017605 A1 * 8/2001 Hashimoto et al. ..... 345/60
2002/0097003 A1 * 7/2002 Takamori et al. ..... 315/169.4
2002/0105278 A1 * 8/2002 Kanazawa ..... 315/169.3
2002/0167466 A1 * 11/2002 Setoguchi et al. ..... 345/60
2003/0222863 A1 * 12/2003 Yun et al. ..... 345/204
2004/0021656 A1 * 2/2004 Kang et al. ..... 345/204
2004/0150354 A1 * 8/2004 Setoguchi et al. ..... 315/169.4

FOREIGN PATENT DOCUMENTS

CN 1339771 3/2002

* cited by examiner

*Primary Examiner*—Amare Mengistu
*Assistant Examiner*—Yuk Chow
(74) *Attorney, Agent, or Firm*—Jianq Chyun IP Office

(57) ABSTRACT

The present invention provides a driving method suitable for a plasma display. The plasma display includes multiple scan electrodes, multiple sustain electrodes and multiple address electrodes, for example. Successive frames are adapted to be displayed in repeating reset periods, address periods and sustain periods by applying driving signals to the scan electrodes, sustain electrodes and address electrodes. The driving method is characterized in that before inputting driving signals or when interrupting driving signals, a wall-charge removing signal is applied to the scan electrodes to remove/reduce the residual wall charges around the scan electrodes and the sustain electrodes. As a result, the possibility of the plasma display generating erroneously discharging with strong light at the restarting state can be effectively reduced.

16 Claims, 6 Drawing Sheets

DRIVING METHOD

BACKGROUND OF THE INVENTION

1. Field of the Invention

The present invention relates to a driving method, and more particularly, to a driving method for plasma displays.

2. Description of Related Art

With the development of multi-media, displays serving as an interface between human and computers are becoming more and more essential. The panel displays include plasma displays, organic electro-luminescent displays (OELD) and liquid crystal displays (LCD). With advantages like big size, self-illuminance, wide-view angle, thinness and full colors, plasma displays are promising and are gradually becoming the mainstream of the next generation of displays.

FIG. 1 is a schematic view of a conventional plasma display. Referring to FIG. 1, the conventional display panel 100 includes a front substrate 110, a rear substrate 120, scan electrodes 112, sustain electrodes 114, address electrodes 122 and ribs 30. The scan electrodes 112 and the sustain electrodes 114 are disposed in pairs on the front substrate 10. The scan electrodes 112 and the sustain electrodes 114 are covered by a dielectric layer 116 and a passivation layer 118. The address electrodes 122 and the ribs 130 are disposed on the rear substrate 120. Multiple discharge spaces 140 filled with discharge air are provided among the ribs 130, the front substrate 10 and the rear substrate 120. A fluorescent layer 150 is positioned in the discharge spaces 140 and on the rear substrate 120. The scan electrodes 112 and the sustain electrodes 114 cross the address electrodes 122 at the discharge spaces 140. When voltages are applied to the scan electrodes 112, the sustain electrodes 114 and the address electrodes 122, the discharge air discharges to produce ultraviolet light to illuminate on the fluorescent layer 150 for lighting a plasma display 100.

FIG. 2 is a timing diagram of driving signals of a conventional plasma display. The frame displayed on the plasma display is composed of multiple sub-frames. Each sub-frame includes a reset period Tr, an address period Ta and a sustain period Ts. In the reset period Tr, reset pulses 202 are applied to the scan electrodes and the sustain electrodes for reducing the residual wall charges during the last sub-frame display. Each display unit of the plasma display can be thereby kept at a same initiation state and the display of the plasma display can have an enhanced uniformity. In the address period Ta, wall charges are accumulated on the to-be-lighting display unit by applying an address pulse 204 to the address electrodes and applying a scan pulse 206 to the scan electrodes. In the sustain period Ts, the display units having wall charges discharge and light with alternate application of sustain pulses to the scan electrodes and the sustain electrodes.

In the above description, the residual wall charges in each sub-frame are removed/reduced by the reset pulses. However, when the display units are kept in the sustain period, the interruption of power will retain wall charges in the display units. When the plasma display restarts, subsequent scan pulses and sustain pulses will be input without the complete reset pulses due to the incompleteness of the driving signals initially input. If the wall charges exist, during the restarting of the plasma display, the gap voltage, which is the sum of the voltage of the wall charges and the voltage of the scan pulse or the sustain pulse, will be larger than the firing voltage of the discharge air, and this condition will make the display units to erroneously discharge with strong light.

SUMMARY OF THE INVENTION

Accordingly, the present invention is directed to a driving method to efficiently remove/reduce the residual wall charges so that the possibility of the plasma display generating erroneously discharging with strong light can be effectively reduced.

According to an embodiment of the present invention, the plasma display includes, for example but not limited to, multiple scan electrodes, multiple sustain electrodes and multiple address electrodes. Successive frames are adapted to be displayed in repeating reset periods, address periods and sustain periods by applying driving signals to the scan electrodes, the sustain electrodes and the address electrodes. The driving method is characterized in that before inputting driving signals or when interrupting driving signals, a wall-charge removing signal is applied to the scan electrodes to remove/reduce the residual wall charges around the scan electrodes and the sustain electrodes. As a result, the possibility of the plasma display producing erroneously discharging with strong light during restarting can be effectively reduced.

BRIEF DESCRIPTION OF THE DRAWINGS

The accompanying drawings are included to provide a further understanding of the invention, and are incorporated in and constitute a part of this specification. The drawings illustrate embodiments of the invention, and together with the description, serve to explain the principles of the invention.

DESCRIPTION OF EMBODIMENTS

Various specific embodiments of the present invention are disclosed below, illustrating examples of various possible implementations of the concepts of the present invention. The following description is made for the purpose of illustrating the general principles of the invention and should not be taken in a limiting sense. The scope of the invention is best determined by reference to the appended claims.

Figure 1:
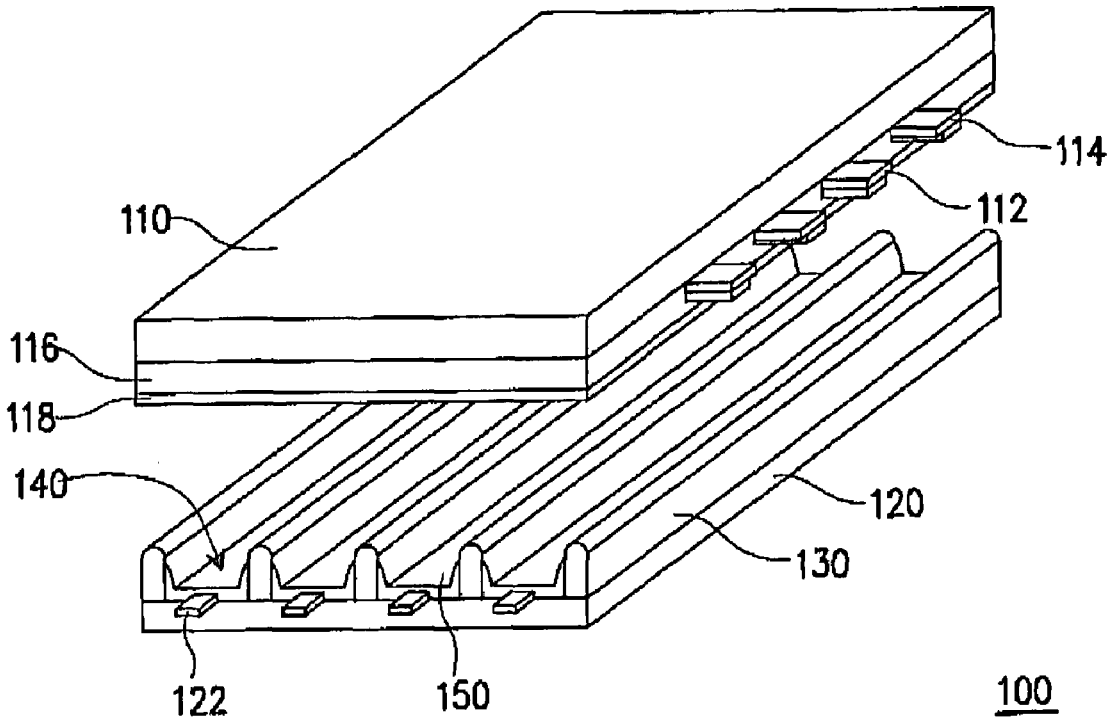
FIG. 1 (PRIOR ART)
FIG. 1 is a perspective view of a conventional plasma display.
Figure 2:
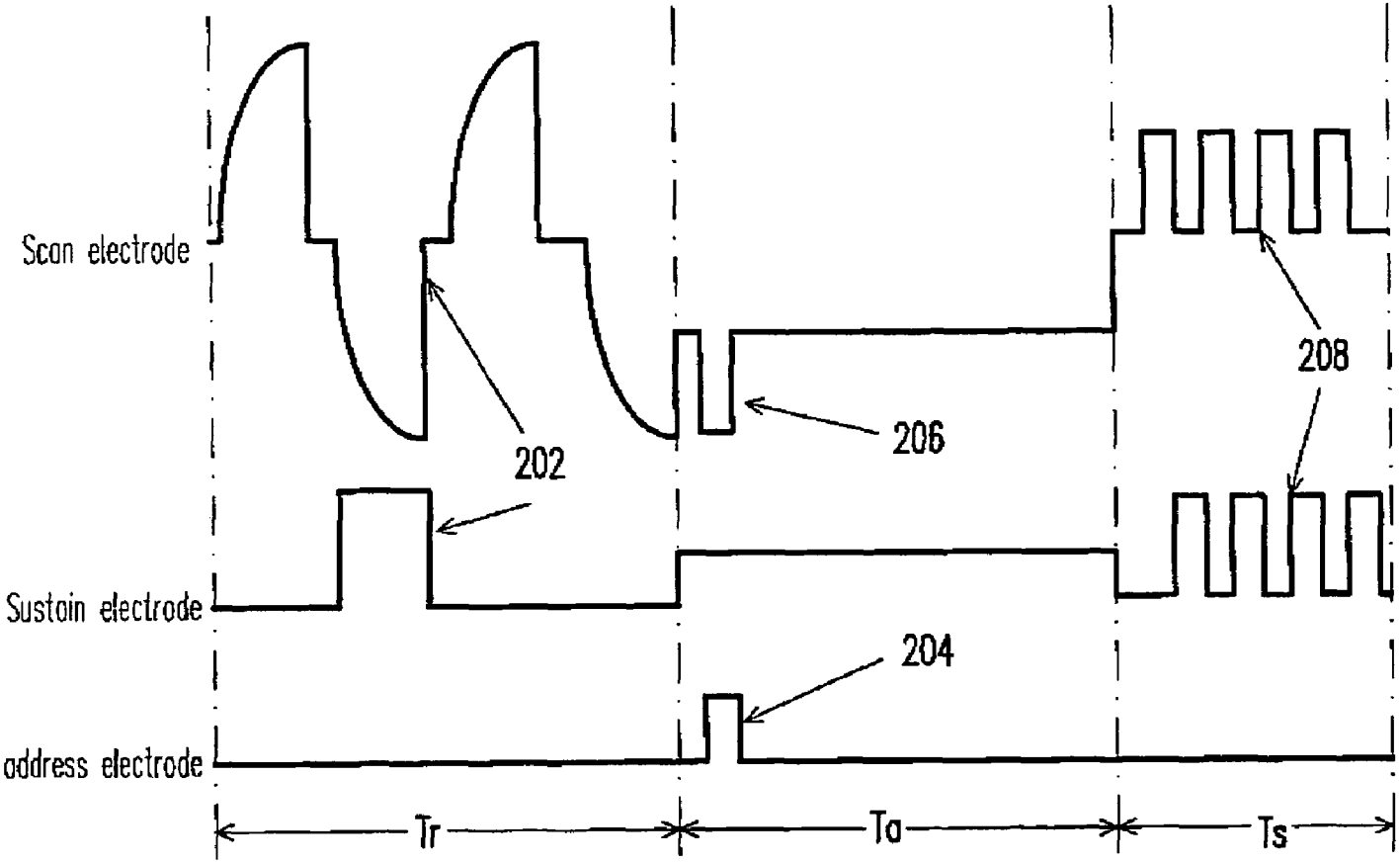
FIG. 2 (PRIOR ART)
FIG. 2 is a timing diagram of driving signals of a conventional plasma display.
Figure 3:
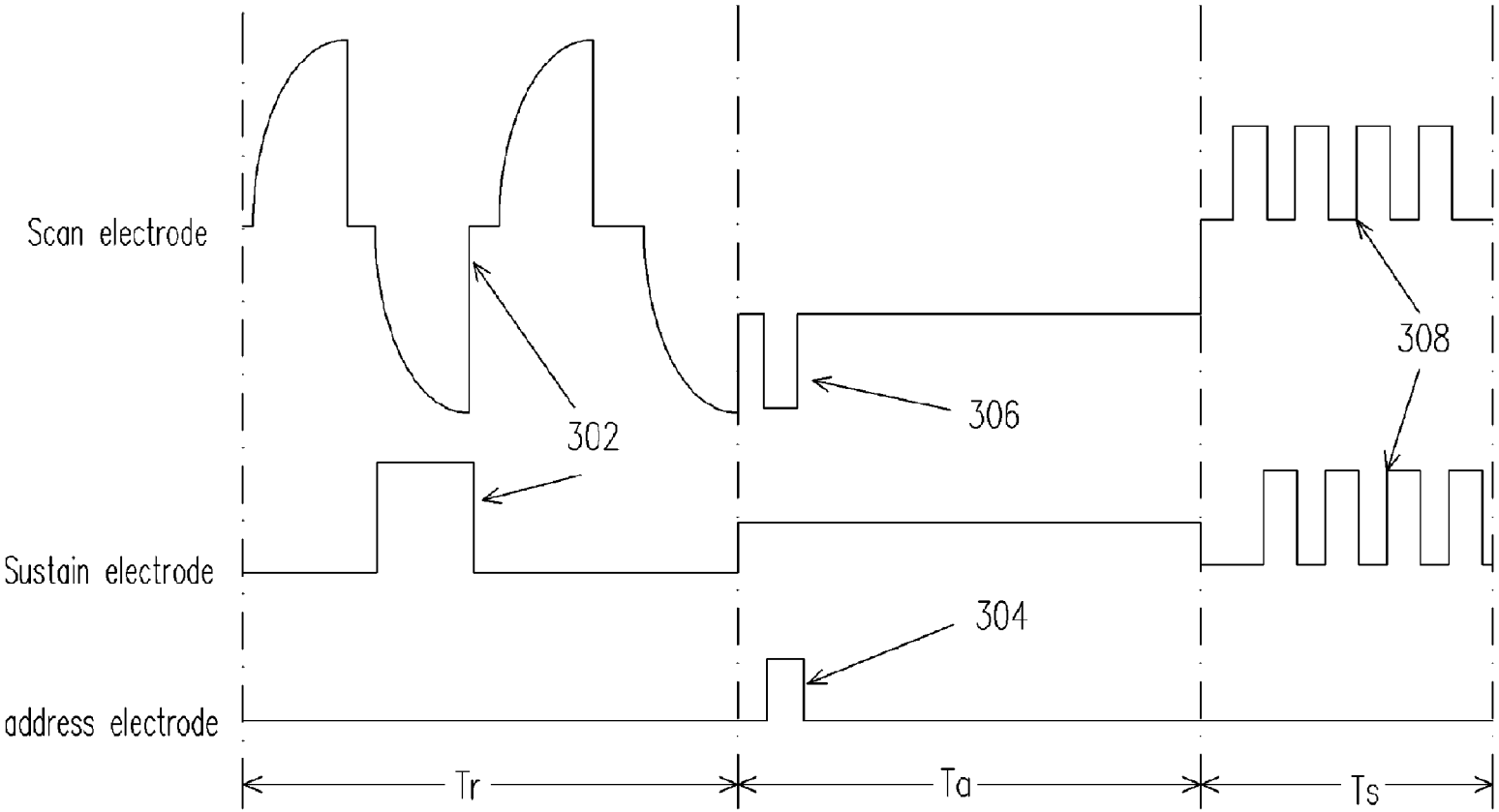
FIG. 3 is a timing diagram of driving signals of a plasma display according to an embodiment of the present invention.

FIG. 3 is a timing diagram of driving signals of a plasma display according to an embodiment of the present invention. Concerning the change of the gray level in displaying images, each frame of a plasma display is divided into multiple sub-frames, wherein sub-frames have various sustain periods. Various gray levels can be displayed by combining various sub-frames. The present invention takes a sub-frame having driving waves as an example.

In the reset period Tr, reset pulses 302 are applied to the scan electrodes and sustain electrodes, leading all display units of the plasma display to discharge and then remove/reduce the charges created due to the discharging. Each display unit of the plasma display can be thereby kept at a same initiation state and the display of the plasma display can have an enhanced uniformity.

In the address period Ta, wall charges are being accumulated on the to-be-lightening display unit by applying an address pulse 204 to the address electrodes and applying a scan pulse 206 to the scan electrodes. In the embodiment, only a timing signal applied to a scan electrode is shown, but in practice, a scan pulse is applied to each scan electrode in turn during the address period Ta to write the corresponding display data into the corresponding display unit when the scan pulse matches one of the address pulse applied to the address electrode.

After the display data are written in all of the display units, sustain pulses 308 with a same voltage level, during the sustain period Ts, are alternately applied to the scan electrodes and the sustain electrodes, leading the display units previously written with display data to discharge and produce light. FIGS. 4A-4D are views showing the change of the wall charges of the display unit during a sustain period.

Figure 4A:
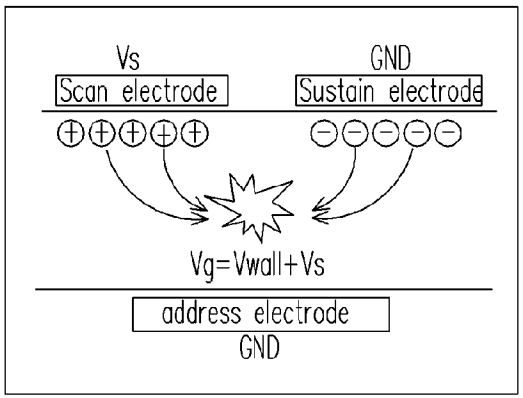
FIGS. 4A-4D are views showing the change of the wall charges of the display unit during a sustain period.
Figure 4B:
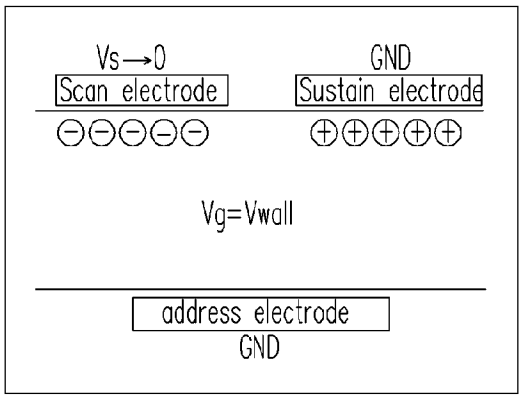
Figure 4C:
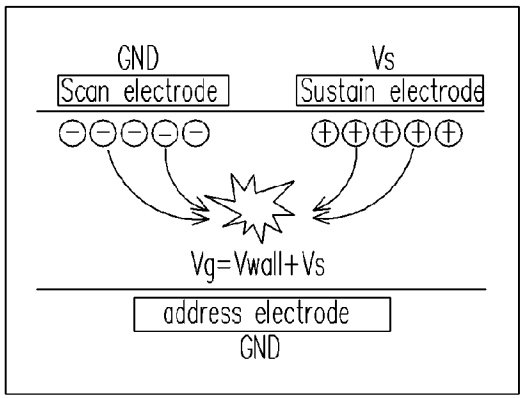
Figure 4D:
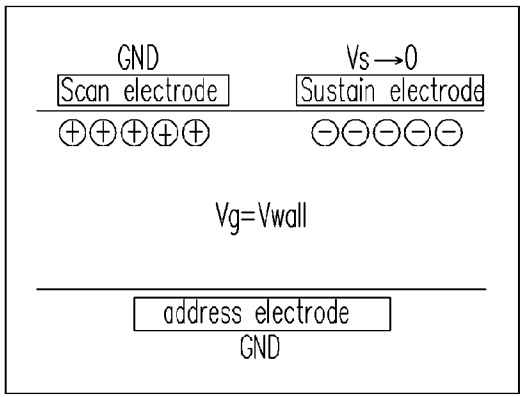

Referring to FIG. 4A, during the sustain period Ts, positive charges and negative charges are accumulated over scan electrodes and sustain electrodes, respectively. When the sustain pulse with the voltage Vs lower than the firing voltage Vf of the discharge air is applied to the scan electrodes and a ground voltage is applied to the sustain electrodes, the positive charges over the scan electrodes and the negative charges over the sustain electrodes will move to the opposite electrodes, subjected to a repulsive force generated between the positive charges and the scan electrodes and subjected to an attractive force generated between the negative charges and the scan electrodes, as shown in FIG. 4B, under the condition that the voltage Vg applied to the discharge air in the display unit, the sum of the wall voltage Vwall created from the wall charges in the display unit previously written with the display data and the sustain voltage Vs (i.e. Vg=Vwall+Vs) is larger than the firing voltage Vf of the discharge air. Therefore, this will cause the discharge air to dissociate and discharge. Afterwards, when the sustain pulse with the voltage Vs is applied to the sustain electrodes and a ground voltage is applied to the scan electrodes, discharging of air will be induced under the condition that the voltage Vg applied to the discharge air in the display unit, the addition of the wall voltage Vwall and the sustain voltage Vs (i.e. Vg=Vwall+Vs) is larger than the firing voltage Vf of the discharge air.

Based on the above description with reference to FIGS. 4A-4D, by applying sustain pulses to the scan electrodes or to the sustain electrodes, the air in the display unit is continuously discharged to produce light. However, in the prior art, when the plasma display is turned off in the sustain period or when the transiting of the driving signals are interrupted, the wall charges will be retained within the display unit and this condition will cause the air to erroneously discharge with strong light at restarting state. In contrast, in the present embodiment of the present invention, before the subsequent driving signals are input, a wall-charge removing signal is applied to the scan electrodes to remove/reduce the residual wall charges on the scan electrodes and the sustain electrodes to reduce the possibility of the display unit to erroneously discharge with strong light.

Figure 5:
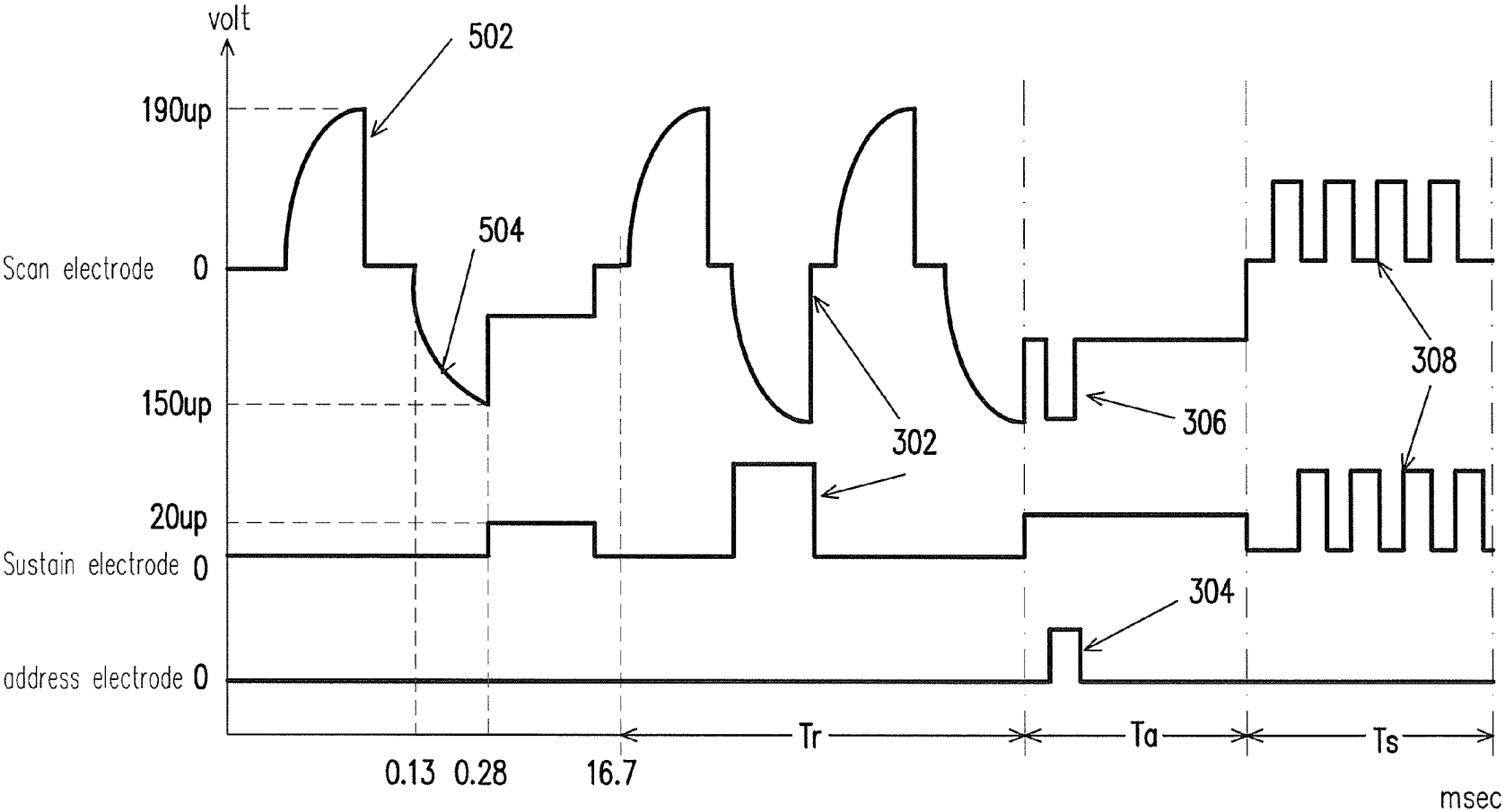
FIG. 5 is a timing diagram of a wall-charge removing signal according to an embodiment of the present invention.

FIG. 5 is a timing diagram of a wall-charge removing signal according to an embodiment of the present invention. The wall-charge removing signal includes a first pulse 502 and a second pulse 504, for example. The first pulse 502 and the second pulse 504 are, for example, a positive exponential wave and a negative exponential wave, respectively. When the driving signals are interrupted during application of the sustain pulse to the sustain electrode, positive charges and negative charges are accumulated over the scan electrodes and the sustain electrodes, respectively. When the first pulse 502, such as a positive exponential wave, is applied to the scan electrodes, the first pulse 502 repulses the positive charges over the scan electrodes, wherein the amplitude, shape and period of the first pulse 502 can be adjusted to reduce the accumulation of the positive charges or the negative charges over the scan electrodes and the sustain electrodes. At this time, the air may slightly discharge, but the illumination created by the slight discharging of air cannot be sensed by eyes because the slope variation of the first pulse 502 that is an exponential wave is relatively small. Therefore, the residual wall charges are removed/reduced by transiting the above wall-charge removing signal. The second pulse 504 is applied to uniformly accumulate wall charges over the scan electrodes and the sustain electrodes, wherein the second pulse 504 can be adjusted to avoid the wall charges from erroneously discharging with strong light.

When the driving signals are interrupted during application of the sustain pulse to the scan electrode, negative charges are accumulated over the scan electrodes and positive charges are accumulated over the sustain electrodes. When the first pulse 502 is applied to the scan electrodes, the negative charges may continue to accumulate. When the second pulse 504, such as a negative exponential wave, is applied to the scan electrodes, the second pulse 504 repulses the negative charges over the scan electrodes, wherein the amplitude, shape and period of the first pulse 504 can be adjusted to reduce the accumulation of the positive charges or the negative charges over the scan electrodes and the sustain electrodes. At this time, the air may slightly discharge, but the illumination created by the slight discharging of air cannot be sensed by eyes, because the slope variation of the second pulse 504 that is an exponential wave is relatively small. Therefore, by the transiting the above wall-charge removing signal, the residual wall charges are effectively removed/reduced.

As described above, erroneous discharging with strong light at restarting state can be reduced by removing/reducing the residual wall charges using the above wall-charge removing signal. Also, similar effect can be achieved by providing the above wall-charge removing signal when a driving signal is interrupted.

Figure 6:
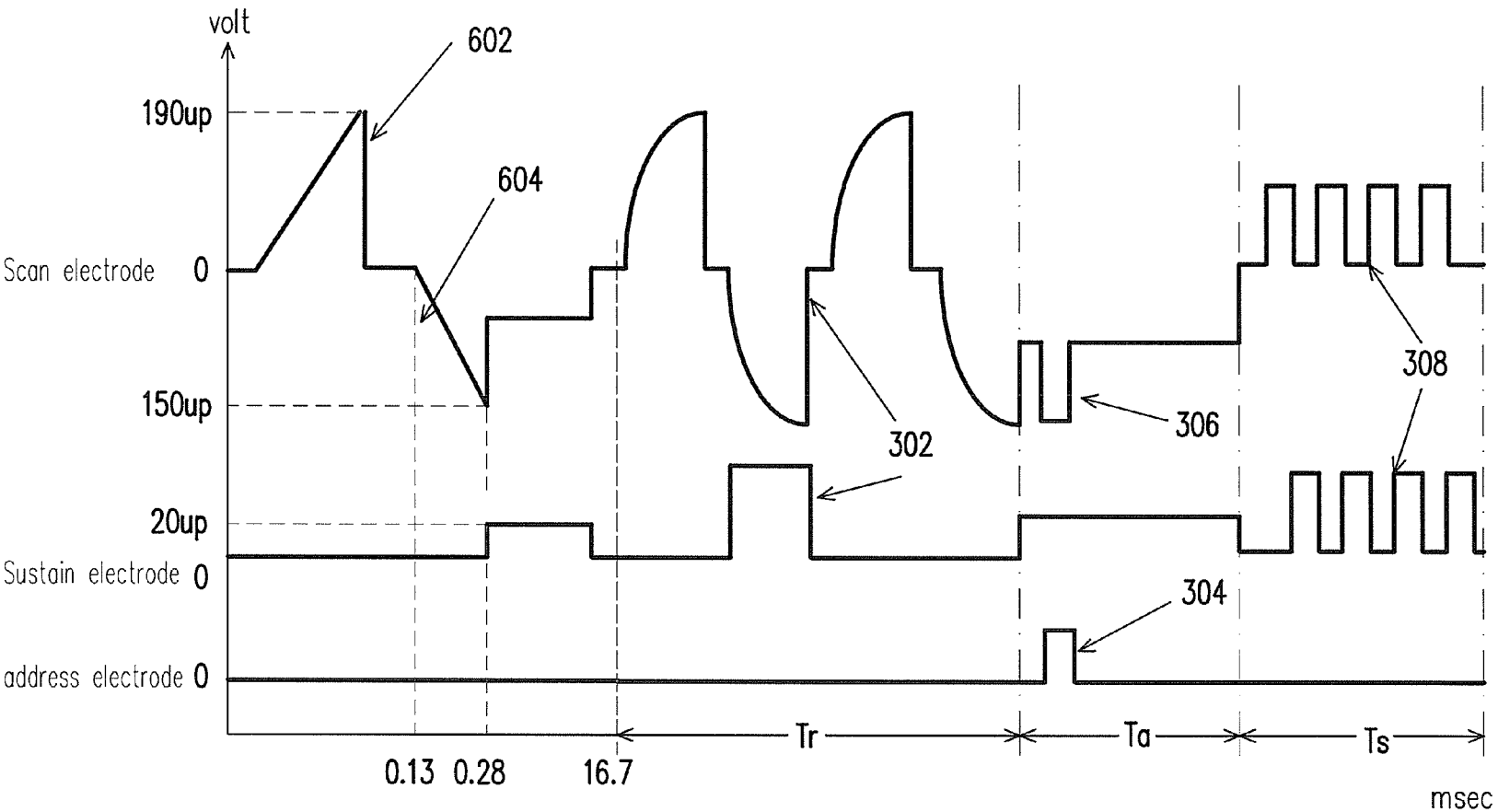
FIG. 6 is a timing diagram of a wall-charge removing signal according to another embodiment of the present invention.

The wall-charge removing signal can be adjusted based on panel traits and driving methods. The wave slope, voltage, number, and position of the first pulses and the second pulses can be modified in practice. For example, FIG. 6 is a timing diagram of a wall-charge removing signal according to another embodiment of the present invention. The first pulse 602 and the second pulse 604 are, for example, a positive triangular wave and a negative triangular wave, respectively. The first pulse 602 and the second pulse 604 are capable of providing effect similar to the above description.

In the present invention, the residual wall charges are removed/reduced by applying the wall-charge removing signal before the next driving signal is input or when the driving signal is interrupted. Therefore, erroneous discharging with strong light at restarting state can be avoided.

Although the invention has been described with reference to a particular embodiment thereof, it will be apparent to one of ordinary skill in the art that modifications to the described embodiment may be made without departing from the spirit of the invention. Accordingly, the scope of the invention will be defined by the attached claims not by the above detailed description.

What is claimed is:

1. A driving method for a plasma display, said plasma display having multiple scan electrodes, multiple sustain electrodes and multiple address electrodes; and adaptable to display multiple successive frames in repeating reset periods, address periods and sustain periods by applying multiple driving signals to said scan electrodes, said sustain electrodes and said address electrodes, the driving method being characterized in that when said plasma display is power off during a sustain pulse within said multiple driving signals alternately applied to said scan electrodes or said sustain electrodes is interrupted, a positive polarity pulse and a negative polarity pulse are successively applied to said scan electrodes just when the plasma display is re-power on and before a reset pulse within said multiple driving signals first applied to said scan electrodes and said sustain electrodes for reducing wall charges over said scan electrodes and over said sustain electrodes.

2. The driving method of claim 1, wherein the position polarity pulse and the negative polarity pulse are included in a wall-charge removing signal.

3. The driving method of claim 2, wherein a wave shape of the positive polarity pulse comprises a positive curve with a decreasing slope.

4. The driving method of claim 2, wherein a wave shape of the negative polarity pulse comprises a negative curve with an increasing slope.

5. The driving method of claim 2, wherein a wave shape of the positive polarity pulse comprises a positive line with a constant slope.

6. The driving method of claim 2, wherein a wave shape of the negative polarity pulse comprises a negative line with a constant slope.

7. The driving method of claim 2, wherein a wave shape of the positive polarity pulse comprises a positive exponential curve.

8. The driving method of claim 2, wherein a wave shape of the negative polarity pulse comprises a negative exponential curve.

9. A driving method for a plasma display, said plasma display having multiple scan electrodes, multiple sustain electrodes and multiple address electrodes; and adaptable to display multiple successive frames in repeating reset periods, address periods and sustain periods by applying multiple driving signals to said scan electrodes, said sustain electrodes and said address electrodes, the driving method being characterized in that a positive polarity pulse and a negative polarity pulse are successively applied to said scan electrodes just when a sustain pulse within said multiple driving signals alternately applied to said scan electrodes or said sustain electrodes is interrupted during a sustain period and before a reset pulse within said multiple driving signals is next applied to said scan electrodes and said sustain electrodes for reducing wall charges over said scan electrodes and over said sustain electrodes.

10. The driving method of claim 9, wherein the position polarity pulse and the negative polarity pulse are included in a wall-charge removing signal.

11. The driving method of claim 9, wherein a wave shape of the positive polarity pulse comprises a positive curve with a decreasing slope.

12. The driving method of claim 9, wherein a wave shape of the negative polarity pulse comprises a negative curve with an increasing slope.

13. The driving method of claim 9, wherein a wave shape of the positive polarity pulse comprises a positive line with a constant slope.

14. The driving method of claim 9, wherein a wave shape of the negative polarity pulse comprises a negative line with a constant slope.

15. The driving method of claim 9, wherein a wave shape of the positive polarity pulse comprises a positive exponential curve.

16. The driving method of claim 9, wherein a wave shape of the negative polarity pulse comprises a negative exponential curve.

* * * * *